US008931195B2

(12) United States Patent
Milde, Jr.

(10) Patent No.: US 8,931,195 B2
(45) Date of Patent: Jan. 13, 2015

(54) SECURE SMARTPHONE-OPERATED GUN LOCK WITH MEANS FOR OVERRIDING RELEASE OF THE LOCK

(71) Applicant: Karl F. Milde, Jr., Mahopac, NY (US)

(72) Inventor: Karl F. Milde, Jr., Mahopac, NY (US)

( * ) Notice: Subject to any disclaimer, the term of this patent is extended or adjusted under 35 U.S.C. 154(b) by 0 days.

(21) Appl. No.: 14/140,658

(22) Filed: Dec. 26, 2013

(65) Prior Publication Data

US 2014/0215883 A1 Aug. 7, 2014

Related U.S. Application Data

(63) Continuation-in-part of application No. 13/763,951, filed on Feb. 11, 2013, now Pat. No. 8,893,420, and a continuation-in-part of application No. 14/017,666, filed on Sep. 4, 2013, now Pat. No. 8,919,024.

(60) Provisional application No. 61/761,270, filed on Feb. 6, 2013, provisional application No. 61/841,559, filed on Jul. 1, 2013.

(51) Int. Cl.
*F41A 17/06* (2006.01)
*F41A 35/00* (2006.01)

(52) U.S. Cl.
CPC ..... *F41A 17/063* (2013.01); *F41A 17/066* (2013.01); *F41A 35/00* (2013.01)
USPC ..... 42/70.11; 42/66; 42/84

(58) Field of Classification Search
CPC ..... F41A 17/02; F41A 17/46; F41A 17/063; F41A 17/066
USPC ..... 42/70.11, 70.01, 70.07, 70.06, 66, 84
See application file for complete search history.

(56) References Cited

U.S. PATENT DOCUMENTS

| | | | | |
|---|---|---|---|---|
| 5,392,552 | A * | 2/1995 | McCarthy et al. | 42/70.07 |
| 5,570,528 | A * | 11/1996 | Teetzel | 42/70.11 |
| 5,675,925 | A * | 10/1997 | Wurger | 42/70.11 |
| 5,713,149 | A * | 2/1998 | Cady et al. | 42/70.06 |
| 6,223,461 | B1 * | 5/2001 | Mardirossian | 42/70.11 |
| 6,293,039 | B1 * | 9/2001 | Fuchs | 42/70.11 |
| 6,301,815 | B1 * | 10/2001 | Sliwa | 42/70.01 |
| 6,314,671 | B1 * | 11/2001 | Gering | 42/70.11 |
| 6,321,478 | B1 * | 11/2001 | Klebes | 42/84 |
| 6,415,542 | B1 * | 7/2002 | Bates et al. | 42/70.11 |
| 6,438,887 | B1 * | 8/2002 | Martin | 42/70.11 |
| 6,711,844 | B2 * | 3/2004 | Rumfelt | 42/70.11 |
| 6,735,897 | B1 * | 5/2004 | Schmitter et al. | 42/70.01 |
| 6,823,621 | B2 * | 11/2004 | Gotfried | 42/70.06 |

(Continued)

*Primary Examiner* — Bret Hayes
*Assistant Examiner* — Joshua Freeman
(74) *Attorney, Agent, or Firm* — Karl F. Milde, Jr.

(57) ABSTRACT

A gun locking and unlocking device, which may be configured to be disposed adjacent the trigger of a gun to alternatively prevent or enable firing, includes a data receiver, a data memory and a logic device for determining whether data received by the receiver is the same, or substantially the same, as data stored in the data memory. One or more separate electronic gun keys are provided to transmit gun lock/unlock data to the data receiver of the gun lock device. The logic device responds to a gun control signal transmitted by one of the gun key devices with priority over a gun control signal transmitted by another gun key device. The logic device automatically locks the gun when it is located in a prohibited area, such as a school. The logic device also locks the gun when the gun user is intoxicated or acting in an irrational manner. Once locked, the user must set a timer which allows the gun to be unlocked only after a specified "wait" time.

25 Claims, 3 Drawing Sheets

(56) References Cited

U.S. PATENT DOCUMENTS

| | | | | |
|---|---|---|---|---|
| 7,600,339 | B2 * | 10/2009 | Schumacher et al. | 42/70.01 |
| 7,703,229 | B2 * | 4/2010 | Parhofer et al. | 42/70.01 |
| 8,127,482 | B2 * | 3/2012 | O'Shaughnessy et al. | 42/70.11 |
| 8,726,556 | B1 * | 5/2014 | Willingham | 42/70.11 |
| 8,756,850 | B2 * | 6/2014 | Dietel | 42/84 |
| 2001/0032405 | A1 * | 10/2001 | Kaminski | 42/70.05 |
| 2001/0042332 | A1 * | 11/2001 | Gering et al. | 42/70.08 |
| 2004/0099134 | A1 * | 5/2004 | Gotfried | 89/1.11 |
| 2006/0242879 | A1 * | 11/2006 | Schmitter | 42/70.01 |
| 2007/0074438 | A1 * | 4/2007 | Parhofer et al. | 42/70.01 |
| 2007/0180749 | A1 * | 8/2007 | Schumacher et al. | 42/70.01 |
| 2008/0039962 | A1 | 2/2008 | McRae | |
| 2009/0064557 | A1 | 3/2009 | Hughes et al. | |
| 2009/0223104 | A1 * | 9/2009 | Anzeloni | 42/70.06 |
| 2011/0030262 | A1 * | 2/2011 | O'Shaughnessy et al. | 42/70.01 |
| 2013/0133234 | A1 * | 5/2013 | Eftekharzadeh | 42/1.02 |
| 2013/0167423 | A1 * | 7/2013 | Lupher et al. | 42/70.06 |
| 2014/0083318 | A1 | 3/2014 | Templ et al. | |
| 2014/0173961 | A1 * | 6/2014 | Goren et al. | 42/70.11 |
| 2014/0173962 | A1 | 6/2014 | Goren et al. | |
| 2014/0182179 | A1 * | 7/2014 | McHale | 42/70.06 |
| 2014/0215881 | A1 * | 8/2014 | Milde et al. | 42/70.06 |
| 2014/0215882 | A1 * | 8/2014 | Milde, Jr. | 42/70.06 |
| 2014/0215883 | A1 * | 8/2014 | Milde, Jr. | 42/70.11 |
| 2014/0215885 | A1 * | 8/2014 | Sullivan et al. | 42/84 |
| 2014/0230301 | A1 * | 8/2014 | Chance et al. | 42/70.06 |
| 2014/0259841 | A1 * | 9/2014 | Carlson | 42/1.01 |

* cited by examiner

SECURE SMARTPHONE-OPERATED GUN LOCK WITH MEANS FOR OVERRIDING RELEASE OF THE LOCK

CROSS-REFERENCE TO RELATED APPLICATION

This application claims priority from the following U.S. patent applications:

(1) Provisional Application No. 61/761,270 filed Feb. 6, 2013, entitled "SECURE SMARTPHONE-OPERATED GUN TRIGGER LOCK;"

(2) patent application Ser. No. 13/763,951, filed Feb. 11, 2013, entitled "SECURE SMARTPHONE-OPERATED GUN TRIGGER LOCK;"

(3) Provisional Application No. 61/841,559 filed Jul. 1, 2013, entitled "SECURE SMARTPHONE-OPERATED GUN LOCK;" and (4) patent application Ser. No. 14/017,666 filed Sep. 4, 2013, and entitled "SECURE SMARTPHONE-OPERATED GUN TRIGGER LOCK."

To the fullest extent permitted by law, these applications are incorporated herein for reference.

BACKGROUND OF THE INVENTION

The present invention relates to a gun lock for a hand gun, such as a pistol or rifle, to prevent the owner or any other person who is authorized to use the gun from firing the gun at times when it is inappropriate or dangerous to do so.

Mechanical gun locks are designed to be installed on the gun in a position behind the trigger to prevent the trigger from firing the gun. These gun locks use a mechanical key that can be easily duplicated, and the locks themselves can be compromised by means of a master key or a lock pick.

Furthermore gun locks can be opened by anyone in possession of one of the keys. With such gun locks it is not possible to restrict the use of the gun to the gun owner or to some other person who is licensed or otherwise authorized to use the gun.

The aforementioned U.S. patent application Ser. No. 13/763,951, filed Feb. 11, 2013 discloses a gun lock which uses a "smartphone," such as an Apple "iPhone," as a key to unlock the gun. This system is difficult to compromise and allows only the gun owner, or some other person who is licensed or otherwise authorized, to use the gun.

Unfortunately, even the owner of a gun, or another person otherwise properly authorized to use the gun, may have the intention, as an act of anger, revenge, hostility or the like, to use the gun inappropriately and thereby cause bodily harm or death to another human being. In such instances, it would be desirable to allow a third person, who may or may not also be authorized to as the gun, and who may or may not be the person in danger of bodily harm or death, to lock the gun and prevent its inappropriate use.

Also, within certain areas, such as in the vicinity of a school, place of worship or other location where people gather, and/or near a particular person who has obtained a protective order against someone who has threatened violence, it would be desirable to prevent the operation of a gun.

Moreover, it would be desirable to prevent the firing of a gun, even by the owner or another person otherwise properly authorized to use the gun, when such owner or authorized person is intoxicated or otherwise acting in less than a sane and sober manner.

Finally, it would be desirable to prevent the firing of a gun in situations where the owner, or another person otherwise properly authorized to use the gun, has not planned in advance to make use of the gun. In this way, it may be possible to avoid unpremeditated uses of the gun that may occur in the "heat of passion."

SUMMARY OF THE INVENTION

An object of this invention, therefore, is to provide a gun, and a gun lock therefor, which enables another person, a GPS locator, a breathalyzer or other phone-App based analyzer, and/or an "expert system" built into a gun lock, to lock the gun with priority over another person who is authorized to use the gun but who may attempt or does attempt to fire the gun inappropriately.

This object, as well as other objects which will become apparent from the discussion that follows, is achieved, in accordance with the present invention, by providing apparatus for locking and unlocking a gun to control its use, which comprises:

(a) a gun lock device configured to be disposed on a gun and responsive to at least one electric signal to select between two operative states, a locked state which prevents the gun from firing and an unlocked state which enables firing;

(b) a data receiver for receiving (1) a gun control signal that specifies one of a locked and an unlocked state, and (2) gun security data;

(a) a data memory for storing gun security data; and (d) a first logic device, coupled to the data receiver and to the data memory, for comparing gun security data received by the data receiver with gun security data stored in the data memory, and for producing the at least one electric signal to actuate the gun lock device in dependence upon the gun control signal and upon whether the stored gun security data and the received gun security data are substantially similar.

According to one important aspect of the invention, the first logic device is operative to cause the gun lock device to either enable the gun to be fired or to prevent the gun from being fired, if and only if the stored gun security data and the received gun security data are substantially similar. In this way, any person having a gun key capable of sending (1) a gun control signal that specifies one of a locked and an unlocked state, and (2) the gun security data, can control the operation of the gun.

The gun security data can comprise a pseudo-random number, but preferably it includes data, such as biologic data, identifying a putative authorized person who wishes to control the operation of the gun.

The term "substantially similar" is intended to mean that the data are sufficiently similar to indicate a match. Biologic data obtained at different times about the same person is never exactly the same, however. Nevertheless, it is sufficiently similar to make it possible to determine with fair certainty whether such data, obtained at different times, identifies the same person.

According to another important aspect of the present invention, there is provided a first gun key device having a data transmitter for transmitting a first gun control signal and first gun security data to the data receiver. This first gun key device includes a second logic device, coupled to the data transmitter, for generating the first gun control signal and the first gun security data for transmission to the data receiver.

Advantageously, the first gun key device further Comprises:

(a) a first input device, for inputting information from a putative authorized person who wishes to control the gun; and (b) a second logic device, coupled to each of the data transmitter and the input device, for generating the first gun security data defined by the putative authorized person for transmission to the data receiver;

wherein the putative authorized person is recognized as a person authorized to control the gun in the event the first gun security data is substantially similar to the stored gun security data.

The information inputted by the putative authorized person may include a password chosen by the putative authorized person and/or biologic identifying information, identifying the putative authorized person.

In the latter case, the stored gun security data represent at least one biologic identifier of an authorized person.

In a preferred embodiment of the invention, the first input device can include a first camera that is operative to record an image of the putative authorized person as a biologic identifier, this image being one or more of:

a facial image;
an image of an iris;
a retinal image;
a fingerprint;
a palm print; and
an image of veins of a hand.

In this case the second logic device is operative to process the image and to generate the first gun security data therefrom.

In another preferred embodiment of the invention the first input device is a microphone, and the second logic device is operative to process a voiceprint of the putative authorized person as a biologic identifier and to generate the first gun security data therefrom.

In still another preferred embodiment of the Invention, the first input device is a first alphanumeric Keyboard. In this case, (i) the putative authorized person may input a first alphanumeric code; and (ii) the putative authorized person is recognized as an authorized person in the event the inputted code matches the stored data.

According to still another important aspect of the present invention, there is provided a second gun key device having a data transmitter for transmitting a second gun control signal and second gun security data to the data receiver.

This second gun key device includes a third logic device, coupled to the data transmitter, for generating the second gun control signal and the second gun security data for transmission to the data receiver.

According to a preferred embodiment of the invention, the second and gun key device further comprises:

(a) a second input device, for inputting information from a putative authorized person who wishes to control the gun; and (b) a third logic device, coupled to each of the data transmitter and the input device, for generating the second gun security data defined by the putative authorized person for transmission to the data receiver;

wherein the putative authorized person is recognized as a person authorized to control the gun in the event the second gun security data is substantially similar to the stored gun security data.

The information inputted by the putative authorized person may include a password chosen by the putative authorized person and/or biologic identifying information, identifying the putative authorized person.

In the latter case, the stored gun security data represent at least one biologic identifier of an authorized person.

In a preferred embodiment of the invention, second input device can include a second camera that is operative to record an image of the putative authorized person as a biologic identifier, this image being one or more of:

a facial image;
an image of an iris;
a retinal image;
a fingerprint;
a palm print; and
an image of veins of a hand;

In this case the second logic device is operative to process the image and to generate the second gun security data therefrom.

In another preferred embodiment of the invention, the second input device is a microphone, and the second logic device is operative to process a voiceprint of the putative authorized person as a biologic identifier and to generate the second gun security data therefrom.

In still another preferred embodiment of the invention, the second input device is a second alphanumeric keyboard. In this case, (i) the putative authorized person may input a first alphanumeric code; and (ii) the putative authorized person is recognized as an authorized person in the event the inputted code matches the stored data.

According to still another important aspect of the present invention, the first logic device responds to the second gun control signal transmitted by the second gun key device with priority over the first gun control signal transmitted by the first gun key device.

According to still another important aspect of the present invention, either the gun itself or a gun key device, or both, are provided with a GPS locator and the logic device of the gun or of the gun key device, respectively, generates a gun control signal which locks the gun and prevents it firing while either the gun or the gun key device is located within a prescribed area.

According to still another aspect of the present invention, there is provided a third and master gun key device having a third data transmitter and a fourth logic device, coupled to the third data transmitter, for transmitting a third gun control signal and third gun security data to the data receiver. The first logic device responds to the third gun control signal transmitted by the third gun key device with priority over any other gun control signal transmitted by any other gun key device.

Finally, according to still another aspect of the present invention, the first gun key device, which is preferably a smartphone, includes an application ("App") that checks the sobriety and sanity of the gun user and requires the user to "plan ahead" and set a timer to enable use of the gun at some time prior to its being unlocked.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
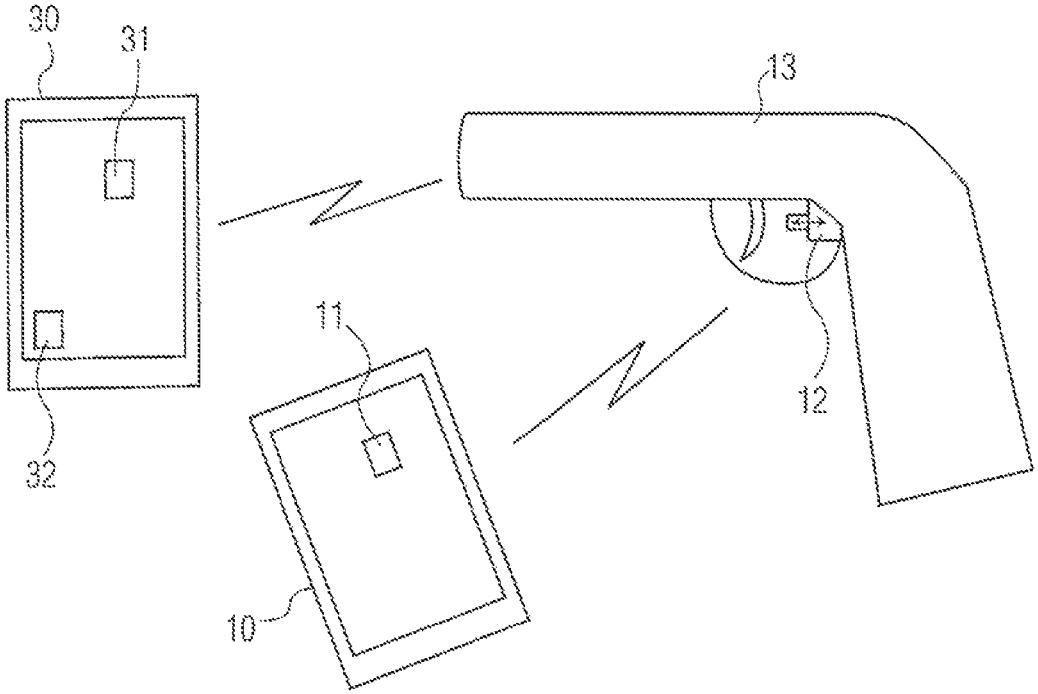
FIG. 1 is a representational diagram showing a smartphone and a gun that is equipped with a gun lock according to the present invention.

The preferred embodiments of the present invention will now be described with reference to FIGS. 1-4 of the drawings. Identical elements in the various figures are identified with the same reference numerals.

Briefly in overview, a battery-operated gun-locking device is permanently attached to, or installed and incorporated in a gun. For example a trigger lock may be installed in a recess behind the trigger or in the lower receiver mechanism of the gun. In its default condition, a movable member is in a forward position, blocking rearward movement of the trigger. When unlocked, the movable member is drawn rearward to allow movement of the trigger.

The gun-locking device has a Bluetooth (or other type) receiver and a memory with stored data. When data matching this stored data is received from a smartphone or similar device, the gun-locking device enables the gun to fire. Otherwise the gun is locked against firing.

FIG. 1 illustrates this configuration. A smartphone 10 has an App that presents a screen button 11 called "Gun Lock" for each gun the smartphone owner owns or is licensed to use. By pressing this button on the App, the owner sends a password, a pseudo-random number or biologic ID security data by a Bluetooth wireless connection to a locking and unlocking device 12 installed permanently in a gun 13.

One or more additional smartphones 30 have an App that presents a screen button 31 called "Gun Lock" that may be used to lock and/or unlock a particular gun (using the password, a pseudo-random number or biologic ID security data) or, as a master key, to lock all guns in the vicinity of the Bluetooth connection. Like the smartphone 10, this smartphone 30 may have a GPS locator 32 which causes the App to automatically send out a signal to lock the gun(s) whenever the smartphone 30 senses that the gun 13, or any other gun, is within its Bluetooth connection area. In this way, the gun 13 (and/or any other gun) may be locked against firing when in the vicinity of a school or any other area where the firing of guns is prohibited.

Figure 2:
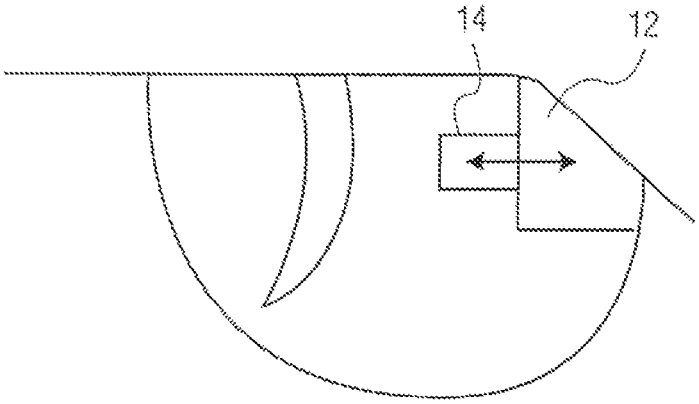
FIG. 2 is a close-up view of the trigger region of the gun of FIG. 1 with the gun lock installed.

FIG. 2 shows a trigger-locking device 12 with a movable member 14, which may be used as a gun locking device. When the device receives a data packet that matches the corresponding data stored in its memory, it draws the movable member 14 back, allowing the trigger to fire the weapon.

The smartphone can be made secure in any number of Ways. It can be password protected or, preferably, it can use of its camera to verify the ID of the person holding this device. For example, the security App may use face recognition or iris recognition software to identify the owner from the camera image.

When the gun locking device 12 is first used, the smartphone App can generate a pseudo-random number and send it to the gun locking device for storage in its permanent memory. Once stored, this number can be changed only by an authorized person, such as the gun owner, or a "registration person" that is duly licensed to perform this function, e.g. by a local or national government. Thereafter, whenever the smartphone sends this number again, the gun locking device releases the lock so the gun may be fired. Before sending the unlock number, the user of the smartphone may be required to identify himself/herself by entering biologic identifying information into the phone for a recognition algorithm. Alternatively, the biologic ID information may be sent to the gun locking device for matching with corresponding biologic identifying data stored therein. In this case, the biologic identifying data, rather than an unlock number must be originally sent and stored in the data memory.

Firing the gun is therefore a two-step process for the gun owner or authorized user:

(1) Verify his/her identify with the smartphone; and (2) Press the Gun Unlock button to enable the gun lock to be released.

The gun remains unlocked until the gun user presses another button on the smartphone App, appropriately called "Gun Lock," or until the gun lock times out and automatically locks itself by restoring the gun lock to the locked position.

The gun locking device 12 is preferably powered by a replaceable and/or rechargeable battery (not shown).

Figure 3:
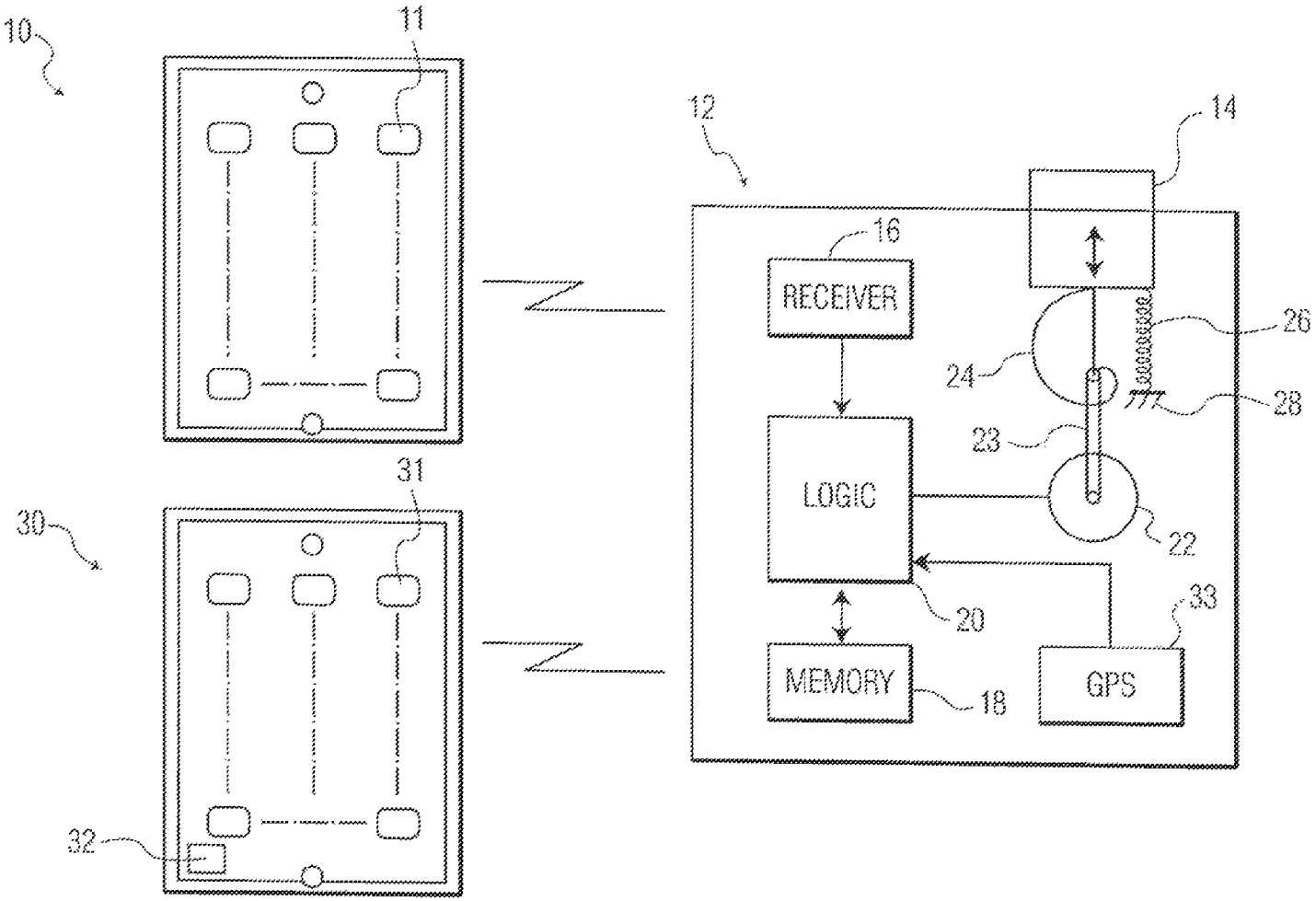
FIG. 3 is a block diagram showing a first preferred embodiment of the gun lock according to the present invention.

FIG. 3 shows the individual elements of the gun lock apparatus. The smartphone 10 transmits to a receiver 16 in the gun locking device 12, preferably via a wireless Bluetooth connection. Alternatively, the smartphone may be coupled to the receiver by a wire connection, for example through a USB port. The receiver 16 and a data memory 18 are both coupled to a logic device 20 that compares the data received from both the receiver and the memory and sends an electric signal to an electromechanical device 22 when and if there is a match.

If biologic ID data has been sent to the receiver by the smartphone 10, the data may not be an exact match; however, the received signature data may be sufficiently close to the stored signature data to satisfy the requirement that the person holding the smartphone 10 is indeed the owner of the gun. Once the right to use the gun has been established, the user of the smartphone 10 can unlock (and, if desired, also lock) the gun.

Similarly, the second smartphone 30 may send a signal to the gun locking device to either to lock or unlock the gun. This smartphone 30 may also be used as a master key, by police for example, and transmit a data packet that matches data stored in all guns and can therefore control (lock and unlock) all guns.

The smartphone 30 may also have a GPS locator 32 and responsive software which automatically sends out a gun locking signal whenever the Bluetooth connection has bean established with a particular gun (matched by the security data) or with all guns in the vicinity (by master key operation as explained above).

According to another embodiment of the invention, the gun locking device itself may include a GPS locater and software that runs in the logic device 20, which automatically causes the gun to lock when it is brought into a prohibited area, such as a school, or other public building or area.

According to another embodiment of the invention, the smartphone 10 may be configured to be attachable to, or may be permanently incorporated into, the gun 13, for example on or in the handle grip.

Figure 4:
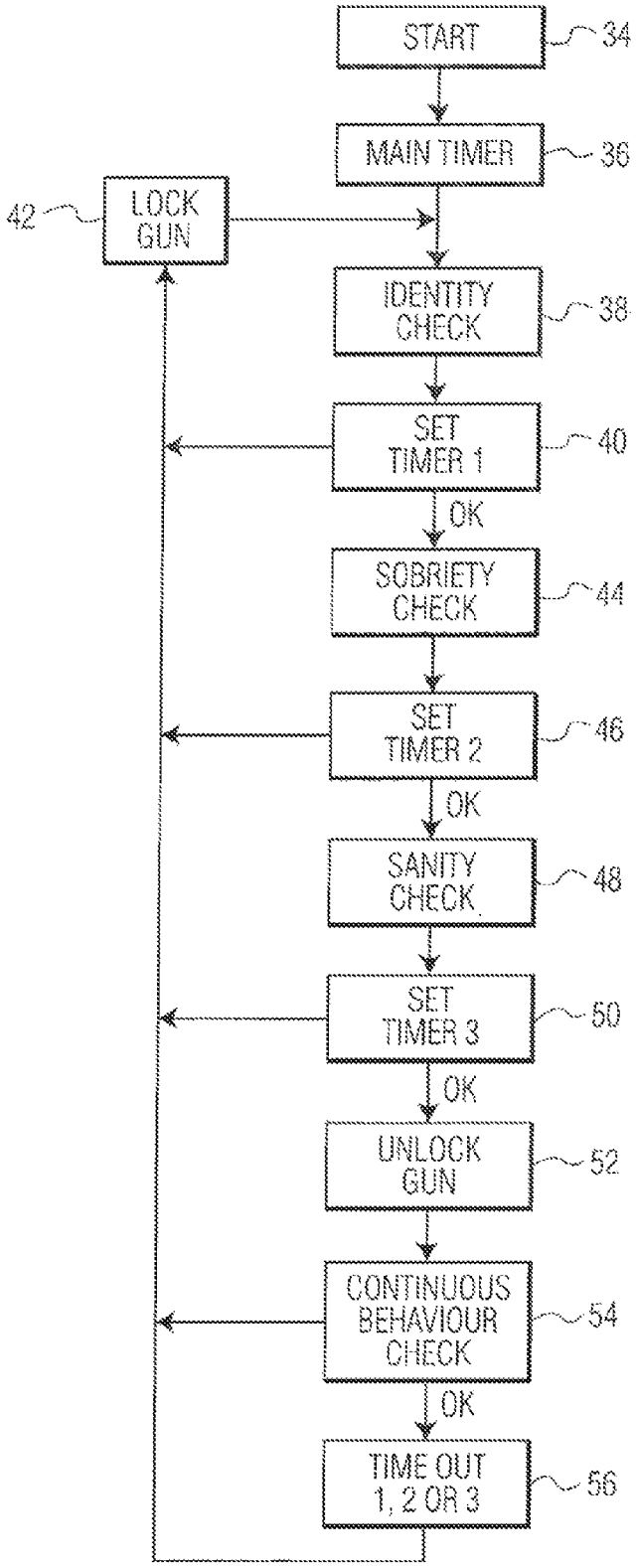
FIG. 4 is a flow chart showing the operation of a smartphone application ("App") according to a second preferred embodiment of the present invention.

FIG. 4 is a flow chart of an algorithm for the App which may be used with the smartphone 10 to ensure that the owner, or any other person who is authorized to use the gun, can use the gun only when it is proper to do so.

When the owner or other authorized person wishes to use the gun, he/she must plan ahead. After the button 11 for gun lock App is initially pressed on the smartphone 10 the algorithm starts at 34 and immediately sets a main timer 36. Only after this timer times out (for example, after an hour, several hours or even a day) does the App allow the gun to be used at all. This initial period prevents the gun from being used except when the owner or authorized person has planned to do so in advance. The smartphone 10 could be programmed to register, and possibly obtain clearance for, the use of the gun with a third party, such as the police, by automatically placing a phone call to the third party during this "blackout period."

Upon the expiration of the time period set in the main timer 36, the App carries out an identity check 38 of the gun user by bio-identification using a camera (for face or iris recognition), a microphone (for voice ID) or a fingerprint scanner. Following this identity check, a first timer 38 is set. If gun owner or other authorized person is not properly identified, the App transfers control to the gun lock 42 which maintains gun in the locked state until the first timer 38 times out. If the gun user is properly identified the App carries out a sobriety check 44, for example by means of a breathalyzer unit plugged into the smartphone 10, and sets a second timer 46. Depending upon the level of intoxication (if any) detected by the breathalyzer, the timer can be set to expire at a time when the user is expected to again reach sobriety. Assuming the user passes the sobriety check, the App conducts a sanity check 48, for example by requiring the user to answer a number of oral or written questions to determine whether the user is acting rationally. The App then sets a third timer 50 before continuing. Assuming the smartphone user answers the questions appropriately and is otherwise authorized or licensed to use the gun, the smartphone unlocks the gun at 52. During use of the gun, the App can continue to monitor the user's behavior at 54 and cause the gun to be locked if inappropriate or irrational behavior is detected. Such behavior may include, for example, angry, inappropriate or irrational comments heard by the smartphone microphone. Finally, if any one of the first, second or third timers times out at 56 the App again causes the gun to be locked at 42.

There has thus been shown and described a novel secure smartphone-operated gun lock which fulfills all the objects and advantages sought therefor. Many changes, modifications, variations and other uses and applications of the subject invention will, however, become apparent to those skilled in the art after considering this specification and the accompanying drawings. All such changes, modifications, variations and other uses and applications which do not depart from the spirit and scope of the invention are deemed to be covered by the invention, which is to be limited only by the claims which follow.

What is claimed is:

1. Apparatus for locking and unlocking a gun to control its use, the apparatus comprising, in combination:

(a) a gun lock device configured to be disposed on a gun and responsive to at least one electric signal to select between two operative states, a locked state which prevents the gun from firing and an unlocked state which enables firing, said gun lock device comprising:

(1) a data receiver for receiving (i) a gun control signal that specifies one of a looked and an unlocked state, and (ii) gun security data;

(2) a data memory for storing gun security data; and (3) a first logic device, coupled to the data receiver and to the data memory, for comparing gun security data received by the data receiver with gun security data stored in the data memory, and for producing the at least one electric signal to actuate the gun lock device in dependence upon the state specified by the gun control signal and upon whether the stored gun security data and the received gun security data are substantially similar;

wherein the first logic device is operative to cause the gun lock device to either enable the gun to be fired or to prevent the gun from being fired in response to the gun control signal when the stored gun security data and the received gun security data are substantially similar;

(b) a first gun key device having a data transmitter for transmitting a first gun control signal and first gun security data to the data receiver, said first gun key device including:

(1) a first input device, for inputting information from a first putative authorized person who wishes to control the gun; and (2) a second logic device, coupled to each of the data transmitter and the input device, for generating the first gun security data defined by the first putative authorized person for transmission to the data receiver;

wherein the first putative authorized person is recognized as a person authorised to control the gun in the event the first gun security data is substantially similar to gun security data stored in the data memory; and (c) a second gun key device having a second data transmitter for transmitting a second gun control signal and second gun security data to the data receiver, said second gun key device including:

(1) a second input device, for inputting information from a second putative authorized person who wishes to control the gun; and (2) a third logic device, coupled to each of the second data transmitter and the second input device, for generating the second gun security data defined by the second putative authorized person for transmission to the data receiver;

wherein the second putative authorized person is recognized as a person authorized to control the gun in the event the second gun security data is substantially similar to gun security data stored in the data memory; and wherein the first logic device responds to the second gun control signal transmitted by the second gun key device with priority over the first gun control signal transmitted by the first gun key device.

2. The gun lock apparatus of claim 1, wherein the gun security data includes a pseudo-random number.

3. The gun look apparatus of claim 1, wherein the gun security data includes data identifying a putative authorized person who wishes to control the operation of the gun.

4. The gun lock apparatus of claim 3, wherein the gun security data includes biologic data identifying the putative authorized person.

5. The gun lock apparatus of claim 1, wherein the information inputted by the first putative authorized person includes a password chosen by the first putative authorized person.

6. The gun lock apparatus of claim 1, wherein the information inputted by the first putative authorized person includes biologic identifying information of the first putative authorized person.

7. The gun lock apparatus of claim 6, wherein the stored gun security data includes security data representing at least one biologic identifier of at least one authorized person.

8. The gun lock apparatus of claim 1, wherein the first input device is a first camera and wherein the second logic device is operative to process an image of the first putative authorized person as a biologic identifier and to generate the first gun security data therefrom.

9. The gun lock apparatus of claim 1, wherein the first input device is a first microphone, and wherein the second logic device is operative to process a voiceprint of the first putative authorized person as a biologic identifier and to generate the first gun security data therefrom.

10. The gun look apparatus of claim 1, wherein the first input device is a first alphanumeric keyboard;

wherein (i) the first putative authorized person may input a first alphanumeric code; and (ii) the first putative authorized person is recognized as an authorized person in the event the inputted code matches gun security data stored in the data memory.

11. The gun lock apparatus of claim 1, wherein the information inputted by the second putative authorized person includes a password chosen by the second putative authorized person.

12. The gun lock apparatus of claim 1, wherein the information inputted by the second putative authorized person includes biologic identifying information of the second putative authorized person.

13. The gun lock apparatus of claim 12, wherein the stored gun security data include security data representing at least one biologic identifier of at least one authorized person.

14. The gun lock apparatus of claim 1, wherein the second input device is a second camera and wherein the third logic device is operative to process an image of the second putative authorized person as a biologic identifier and to generate the first gun security data therefrom.

15. The gun lock apparatus of claim 1, wherein the second input device is a microphone, and wherein the third logic device is operative to process a voiceprint of the second putative authorized person as a biologic identifier and to generate the second gun security data therefrom.

16. The gun lock apparatus of claim 1, wherein the second input device is a second alphanumeric keyboard;

wherein (i) the second putative authorized person may input a second alphanumeric code; and (ii) the second putative authorized person is recognized as an authorized person in the event the inputted code matches gun security data stored in the data memory.

17. The gun look apparatus of claim 1, further comprising a GPS locater connected to said first logic device, and wherein the first logic device is operative to set the gun said first logic device is operative to maintain the gun in a locked state and prevent the gun from being fired when said gun is in a prescribed area.

18. The gun lock apparatus of claim 1, wherein said second logic device is responsive to information received by said first input device to maintain the gun lock device in the locked state upon the occurrence of at least one of the following:

(1) the first putative authorized person tests positive for an intoxicating substance;

(2) the first putative authorized person fails to answer certain questions correctly.

19. The gun lock apparatus of claim 1, wherein said first gun key device is attachable to the gun with said gun look device.

20. The gun lock device of claim 1, wherein said first gun key device has a GPS locater coupled to said second logic device, and wherein said second logic device is operative to cause said data transmitter to transmit a gun control signal to set the gun in a locked state and prevent its firing when said first gun key device is in a prescribed area.

21. The gun lock apparatus of claim 1, further comprising a third, master gun key device having a fourth logic device, coupled to a third data transmitter, for generating and transmitting a third gun control signal and third gun security data for transmission to the data receiver, wherein the first logic device responds to the third gun control signal transmitted by the third gun key device with priority over a gun control signal transmitted by another gun key device.

22. The gun lock apparatus of claim 1, wherein said second logic device is responsive to an unlock command received from the first input device to maintain said gun lock device in the locked state for a prescribed time and thereafter to change the gun look device to the unlocked state.

23. Apparatus for locking and unlocking a gun to control its use, the apparatus comprising, in combination:

(a) a gun look device configured to be disposed on a gun and responsive to at least one electric signal to select between two operative states, a locked state which prevents the gun from and an unlocked state which enables firing, said gun lock device comprising:

(1) a data receiver for receiving (i) a gun control signal that specifies one of a locked and an unlocked state, and (ii) gun security data;

(2) a data memory for storing gun security data; and (3) a first logic device, coupled to the data receiver and to the data memory, for comparing gun security data received by the data receiver with gun security data stored in the data memory, and for producing the at least one electric signal to actuate the gun lock device in dependence upon the state specified by the gun control signal and upon whether the stored gun security data and the received gun security data are substantially similar;

wherein the first logic device is operative to cause the gun lock device to either enable the gun to be fired or to prevent the gun from being fired in response to the gun control signal when the stored gun security data and the received gun security data are substantially similar;

(b) a first gun key device having a data transmitter for transmitting a first gun control signal and first gun security data to the data receiver, said first gun key device including:

(1) a first input device, for inputting information from a first putative authorized person who wishes to control the gun; and (2) a second logic device, coupled to each of the data transmitter and the first input device, for generating the first gun security data defined by the first putative authorized person for transmission to the data receiver;

wherein the first putative authorized person is recognized as a person authorized to control the gun in the event the first gun security data is substantially similar to gun security data stored in the data memory;

wherein said first gun key device has a GPS locater coupled to said second logic device, and wherein said second logic device is operative to cause said data transmitter to transmit a gun control signal to set the gun in a looked state and prevent its firing when said first gun key device is in a prescribed area.

24. Apparatus for locking and unlocking a gun to control its use, the apparatus comprising, in combination:

(a) a gun lock device configured to be disposed on a gun and responsive to at least one electric signal to select between two operative states, a locked state which prevents the gun from firing and an unlocked state which enables firing, said gun lock device comprising:

(1) a data receiver for receiving (i) a gun control signal that specifies one of a locked and an unlocked state, and (ii) gun security data;

(2) a data memory for storing gun security data; and (3) a first logic device, coupled to the data receiver and to the data memory, for comparing gun security data received by the data receiver with gun security data stored in the data memory, and for producing the at least one electric signal to actuate the gun lock device in dependence upon the state specified by the gun control signal and upon whether the stored gun security data and the received gun security data are substantially similar;

wherein the first logic device is operative to cause the gun lock device to either enable the gun to be fired or to prevent the gun from being fired in response to the gun control signal when the stored gun security data and the received gun security data are substantially similar;

(b) a first gun key device having a data transmitter for transmitting a first gun control signal and first gun security data to the data receiver, said first gun key device including:

(1) a first input device, for inputting information from a first putative authorized person who wishes to control the gun; and (2) a second logic device, coupled to each of the data transmitter and the input device, for generating the first gun security data defined by the first putative authorized person for transmission to the data receiver;

wherein the first putative authorized person is recognized as a person authorized to control the gun in the event the first gun security data is substantially similar to gun security data stored in the data memory; and (c) a second and master gun key device having a third logic device, coupled to a second data transmitter, for generating and transmitting a second gun control signal and second gun security data for transmission to the data receiver, wherein the first logic device responds to the second gun control signal transmitted by the second gun key device, with priority over a gun control signal transmitted by the first gun key device.

25. Apparatus for locking and unlocking a gun to control its use, the apparatus comprising, in combination:

(a) a gun lock device configured to be disposed on a gun and responsive to at least one electric signal to select between two operative states, a locked state which prevents the gun from firing and an unlocked state which enables firing, said gun lock device comprising:

(1) a data receiver for receiving (i) a gun control signal that specifies one of a locked and an unlocked state, and (ii) gun security data;

(2) a data memory for storing gun security data; and (3) a first logic device, coupled to the data receiver and to the data memory, for comparing gun security data received by the data receiver with gun security data stored in the data memory, and for producing the at least one electric signal to actuate the gun lock device in dependence upon the state specified by the gun control signal and upon whether the stored gun security data and the received gun security data are substantially similar;

wherein the first logic device is operative to cause the gun lock device to either enable the gun to be fired or to prevent the gun from being fired in response to the gun control signal when the stored gun security data and the received gun security data are substantially similar;

(b) a first gun key device having a data transmitter for transmitting a first gun control signal and first gun security data to the data receiver, said first gun key device including:

(1) a first input device, for inputting information from a first putative authorized person who wishes to control the gun; and (2) a second logic device, coupled to each of the data transmitter and the input device, for generating the first gun security data defined by the first putative authorized person for transmission to the data receiver;

wherein the first putative authorized person is recognized as a person authorized to control the gun in the event the first gun security data is substantially similar to gun security data stored in the data memory; and wherein said second logic device is responsive to an unlock command received from the first input device to maintain said gun lock device in the locked state for a prescribed time and thereafter to change the gun lock device to the unlocked state.

* * * * *